United States Patent [19]

Taylor

[11] 4,285,631

[45] Aug. 25, 1981

[54] RADIAL FLOW CENTRIFUGAL IMPELLER

[75] Inventor: Peter J. Taylor, Fareham, England

[73] Assignee: Plessey Handel und Investments AG, Zug, Switzerland

[21] Appl. No.: 87,770

[22] Filed: Oct. 24, 1979

[30] Foreign Application Priority Data

Nov. 20, 1978 [GB] United Kingdom ..... 45184/78

[51] Int. Cl.[3] ..... F01D 1/06

[52] U.S. Cl. ..... 415/143; 415/168; 415/206

[58] Field of Search ..... 415/206, 203, 204, 168, 415/143

[56] References Cited

U.S. PATENT DOCUMENTS

| | | | |
|---|---|---|---|
| 1,669,581 | 5/1928 | Spencer | 415/204 |
| 1,889,816 | 12/1932 | White | 415/204 |
| 2,581,055 | 1/1952 | Wahle | 415/206 |
| 2,780,999 | 2/1957 | Compton et al. | 415/168 |
| 3,726,605 | 4/1973 | Bachl | 415/203 |

FOREIGN PATENT DOCUMENTS

| | | | |
|---|---|---|---|
| 2216840 | 8/1974 | France | 415/206 |

*Primary Examiner*—Robert E. Garrett

*Attorney, Agent, or Firm*—Fleit & Jacobson

[57] ABSTRACT

A radial flow centrifugal impeller comprising an even number of re-heat flow ports, a main engine flow port, and a drive shaft having a helical impeller arrangement provided on its circumference and impeller blades mounted on the circumference of the helical impeller arrangement, each impeller blade having a flat peripheral first portion adjacent each re-heat flow port and a flat peripheral second portion adjacent the main engine flow port, the ratio of the size of the first portions on all the impeller blades to the size of the second portions on all the impeller blades being effective to control the ratio of the fuel flowing through the re-heat flow ports and the main engine flow port, and the re-heat flow ports being symmetrically disposed about the radial flow centrifugal impeller.

3 Claims, 1 Drawing Figure

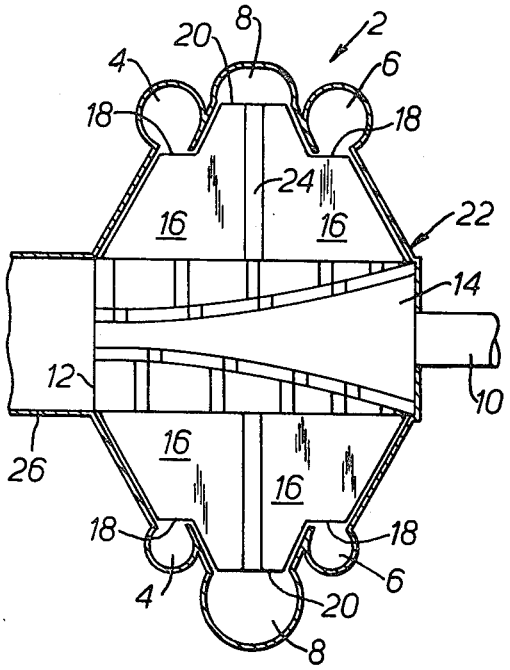
2
8
20
4
6
18
18
24
16
16
22
14
12
10
26
16
16
18
18
4
6
20
8

RADIAL FLOW CENTRIFUGAL IMPELLER

This invention relates to a radial flow centrifugal impeller.

Accordingly, this invention provides a radial flow centrifugal impeller comprising an even number of re-heat flow ports, a main engine flow port, and a drive shaft having a helical impeller arrangement provided on its circumference and impeller blades mounted on the circumference of the helical impeller arrangement, each impeller blade having a flat peripheral first portion adjacent each re-heat flow port and a flat peripheral second portion adjacent the main engine flow port, the ratio of the size of the first portions on all the impeller blades to the size of the second portions on all the impeller blades being effective to control the ratio of the fuel flowing through the re-heat flow ports and the main engine flow port, and the re-heat flow ports being symmetrically disposed about the radial flow centrifugal impeller.

The radial flow centrifugal impeller of the present invention is advantageous in that it enables the main engine fuel flow and the re-heat fuel flow and their pressure requirements to be achieved within one single impeller. The use of one impeller for providing the main engine and the re-heat fuel flow enables a compact unit to be produced of a relatively low weight. Because the main engine and the re-heat fuel flows pass through the same impeller, when re-heat is not being used, the heat generated by the re-heat section is passed directly into the main engine flow and is consumed by the engine. Furthermore, the use of a single impeller for providing both the main engine and the re-heat fuel flows enables a saving in the cost of a separate re-heat pump and its associated drive from the engine.

The re-heat fuel flow ports are symmetrically disposed about the radial flow centrifugal impeller in order the ensure that, during operation, the radial flow centrifugal impeller is correctly balanced. If the re-heat flow ports were not symmetrically disposed about the radial flow centrifugal impeller, then, during use, the radial flow centrifugal impeller would wear rapidly.

Preferably, there are two re-heat flow ports.

The impeller blades may be fixed by any appropriate means, such for example as brazing, to the helical impeller arrangement.

Usually, the impeller blades will be supported on a centrally disposed plate located in the radial flow centrifugal impeller.

An embodiment of the invention will now be described solely by way of example and with reference to the accompanying drawing.

Referring to the drawing, there is shown a radial flow centrifugal impeller 2 comprising a pair of re-heat flow ports 4,6, a main engine flow port 8 and a drive shaft 10. The cross-sectional size of the ports 4, 6, 8 varies as shown in the drawing to provide the appropriate re-heat and main engine fuel flows and pressures.

The drive shaft 10 is provided with a helical impeller arrangement 12 on its circumference. As shown in the drawing, the helical impeller arrangement 12 decreases in helical depth towards the right hand side of the drawing where the hub 14 of the drive shaft 10 flares outwardly. The helical impeller arrangement 12 can be brazed to the hub 14 of the drive shaft 10.

A plurality of impeller blades 16 are mounted on the circumference of the helical impeller arrangement 12. Each impeller blade 16 has a flat peripheral first portion 18 adjacent the re-heat flow ports 4, 6. Each impeller blade 16 also has a flat peripheral second portion 20 adjacent the main engine flow port 8. The ratio of the size of the first portions 18 on all the impeller blades 16 to the size of the second portions 20 on all the impeller blades 16 is effective to control the ratio of the fuel flowing through the re-heat flow ports 4, 6 and the main engine glow port 8.

It will be noticed that the re-heat flow ports 4, 6 are symmetrically disposed about the radial flow centrifugal impeller 2 to ensure that the radial flow centrifugal impeller 2 is correctly balanced in use. This prevents undue wear occurring due to imbalance forces which would occur during operation of the radial flow centrifugal impeller 2 if it were not correctly balanced.

The radial flow centrifugal impeller has a shroud 22 which can be regarded as following the general peripheral shape of the impeller blades 16 and the ports 4, 6, 8. The shroud 22 is provided with a centre plate 24 and the impeller blades 16 are attached to this centre plate 24, for example by brazing or other means. The impeller blades 16 are also attached, for example by brazing or other means, to the helical impeller arrangement 12. Thus, when the drive shaft 10 is rotated, the helical impeller arrangement 12 and the impeller blades 16 both start to rotate to draw in fuel through an inlet pipe 26 and to correctly apportion this fuel to the ports 4, 6, 8. If fuel is not required to pass through the ports 4, 6 then fuel temperature reductions compared with known devices may be achieved by not having to recirculate fuel from a re-heat pump when re-heat is inoperative.

It is to be appreciated that the embodiment of the invention described above has been given by way of example and that modifications may be effected. For example, the peripheral shape of the impeller blades 16 may be varied.

What we claim is:

1. A radial flow centrifugal impeller comprising an even number of re-heat flow ports, a main engine flow port, and a drive shaft having a helical impeller arrangement provided on its circumference and impeller blades mounted on the circumference of the helical impeller arrangement, each impeller blade having a flat peripheral first portion adjacent each re-heat flow port and a flat peripheral second portion adjacent the main engine flow port, the ratio of the size of the first portions on all the impeller blades to the size of the second portions on all the impeller blades being effective to control the ratio of the fuel flowing through the re-heat flow ports and the main engine flow port, and the re-heat flow ports being symmetrically disposed about the radial flow centrifugal impeller.

2. A radial flow centrifugal impeller according to claim 1 in which there are two re-heat flow ports.

3. A radial flow centrifugal impeller according to claim 1 or claim 2 in which the impeller blades are supported on a centrally disposed plate.

* * * * *